US005973641A

United States Patent [19]

Smith et al.

[11] Patent Number: 5,973,641

[45] Date of Patent: Oct. 26, 1999

[54] ANTENNA FEED NETWORK ARRANGEMENT

[75] Inventors: Adrian David Smith, Paignton; Martin Stevens Smith; David Neil Adams, both of Chelmsford, all of United Kingdom

[73] Assignee: Northern Telecom Limited, Montreal, Canada

[21] Appl. No.: 08/849,272

[22] PCT Filed: Nov. 23, 1995

[86] PCT No.: PCT/GB95/02735

§ 371 Date: May 22, 1997

§ 102(e) Date: May 22, 1997

[87] PCT Pub. No.: WO96/17404

PCT Pub. Date: Jun. 6, 1996

[30] Foreign Application Priority Data

Nov. 28, 1994 [GB] United Kingdom ..... 9424119

[51] Int. Cl.[6] ..... H01Q 3/22; H01Q 3/24; H01Q 3/26

[52] U.S. Cl. ..... 342/372

[58] Field of Search ..... 342/371, 372, 342/368, 157

[56] References Cited

U.S. PATENT DOCUMENTS

| | | | |
|---|---|---|---|
| 4,045,800 | 8/1977 | Tang et al. . | |
| 4,652,883 | 3/1987 | Andricos | 342/372 |
| 5,414,433 | 5/1995 | Chang | 342/375 |

*Primary Examiner*—Theodore M. Blum
*Attorney, Agent, or Firm*—Lee, Mann, Smith, McWilliams, Sweeney & Ohlson

[57] ABSTRACT

In accordance with the present invention, there is provided a linear antenna array comprising a number of antenna elements and a feed network, wherein the feed network is operable to apply the cumulative effect of a progressive phase shift across the antenna elements of the array and a stepped complex operator shift to selected groups of antenna elements of the array, whereby a down tilted and null-free coverage by a resulting radiation pattern can thereby be provided. The complex operator can be phase, amplitude or a combination of both. The antenna array can be a layered antenna and the phase shifts in the feed network can be provided by differing length transmission paths, whilst any amplitude shift can be provided by unequal power dividers. In order to provide no down tilt and just null fill-in, then the progressive phase shift can be specified to be zero.

18 Claims, 6 Drawing Sheets

ANTENNA FEED NETWORK ARRANGEMENT

This invention relates to a base station arrangement as used in cellular radio communications systems and in particular relates to an antenna feed network arrangement having a null-free coverage and more particularly to an antenna arrangement having a null-free coverage and downtilt capabilities.

Cellular radio systems are used to provide telecommunications to mobile users. In order to meet the capacity demand, within the available frequency band allocation, cellular radio systems divide a geographic area to be covered into cells. At the centre of each cell is a base station through which the mobile stations communicate with each other and with a fixed (wired) network. The available communication channels are divided between the cells such that the same group of channels are reused by certain cells. The distance between the reused cells is planned such that co-channel interference is maintained at a tolerable level.

When a new cellular radio system is initially deployed operators are often interested in maximising the uplink (mobile station to base station) and downlink (base station to mobile station) range. Any increase in range means that less cells are required to cover a given geographic area, hence reducing the number of base stations and associated infrastructure costs. The downlink range is primarily increased by increasing the radiated power from the base station. National regulations, which vary from country to country, set a maximum limit on the amount of effective isotropic radiated power (EIRP) which may be emitted from a particular type of antenna being used for a particular application. In Great Britain, for example, the EIRP limit for digital cellular systems is currently set at +56 dBm. Hence the operator is constrained and, in order to gain the maximum range allowable, must operate as close as possible to the EIRP limit, without exceeding it. In cellular radio base stations, the antennas are generally arranged to cover sectors, of typically 120° in azimuth—for a trisectored base station. The antenna arrays comprise a number of vertically oriented layered antenna arrays to provide an M×N array to serve a sector. Each vertically oriented antenna array is positioned parallel with the other linear antenna arrays. The radiating antenna elements of a vertical array cooperate to provide a central narrow beam coverage in the elevation plane and broad coverage in azimuth, radiating normally in relation to the vertical plane of the antenna array. In the elevation plane the radiation pattern consists of a narrow "main" beam with the full gain of the antenna array, plus "side lobes" with lower gains. With a uniform phase excitation for the antenna array, there are deep "nulls" between the main lobe and the first side lobes on either side. These produce undesirable "holes" in the base station coverage.

Downtilt in the cellular radio environment is used to decrease cell size from a beam shape directed to the horizon to the periphery of the cell. This provides a reduction in beam coverage, yet allows a greater number of users to operate within a cell since there is a reduction in the number of interfering signals. The antennas used in a base station can be of a layered or tri-plate form and each antenna radiating element of an antenna array is formed on the same layer.

This tilt can be obtained by mechanically tilting the antenna array or by differences in the electrical feed network for all the antenna elements in the antenna array. Electrical downtilt can be used to controllably steer a radiation beam downwardly from an axis corresponding to a normal subtended by an array plane and results from a consecutive phase change in the signal fed to each antenna element in an antenna array. Mechanical downtilting is simple yet requires optimisation on site; electrical downtilting allows simple installation yet requires complex design. However, neither forms of downtilting compensate for nulls which are formed between lobes in the radiation pattern.

The present invention seeks to overcome or reduce the above mentioned problems.

In accordance with the present invention, there is provided a linear antenna array comprising a number of antenna elements and a feed network, wherein the feed network is operable to apply the cumulative effect of a progressive phase shift across the antenna elements of the array and a stepped complex operator shift to selected groups of antenna elements of the array, whereby a downtilted and null-free coverage by a resulting radiation pattern can thereby be provided.

The complex operator can be phase, amplitude or a combination of both. The antenna array can be a layered antenna and the phase shifts in the feed network can be provided by differing length transmission paths, whilst any amplitude shift can be provided by unequal power dividers. In order to provide no downtilt and just null fill-in, then the progressive phase shift can be specified to be zero.

In accordance with a further aspect of the invention, there is provided a method of operating an antenna array comprising a number of antenna elements and a feed network; the method steps comprising the application of a progressive phase shift in the signals fed to consecutive antenna elements in the array and a stepped complex operator shift to selected groups of antenna elements of the array, whereby a resultant radiation distribution is downtilted and the distribution between the main lobe and first sidelobes is null-free.

The complex operator can be phase, amplitude or a combination of both. The antenna array can be a layered antenna and the phase shifts in the feed network can be provided by differing length transmission paths, whilst any amplitude shift can be provided by unequal power dividers. If null fill-in is required, but downtilt is unnecessary, then the progressive phase shift can be specified to be zero.

In order that the present invention is more fully understood, reference will now be made to the Figures as shown in the accompanying drawing sheets, wherein:

FIG. 1 is a schematic representation of a beam from a mechanically downtilted antenna array in vertical section;

FIGS. 2*a, b* & *c* show the angular radiation intensity distribution, signal amplitude distribution and signal phase distribution of an antenna array having uniform amplitude and phase shifts accross the array;

Figure 5A:
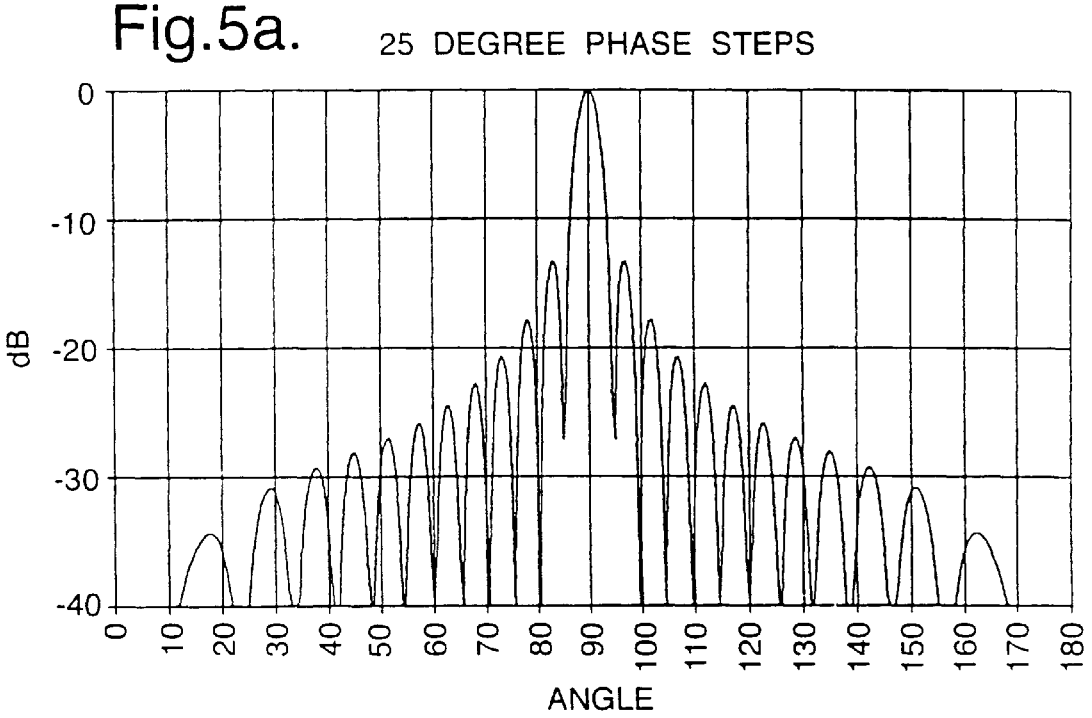
Figure 5B:
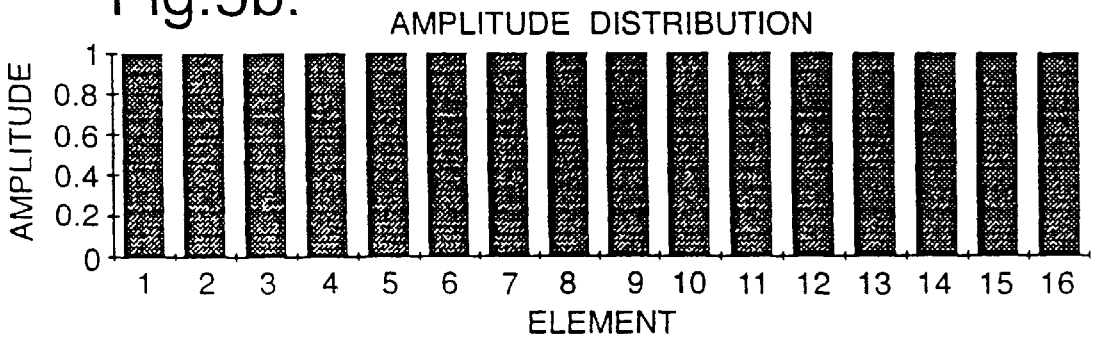
Figure 5C:
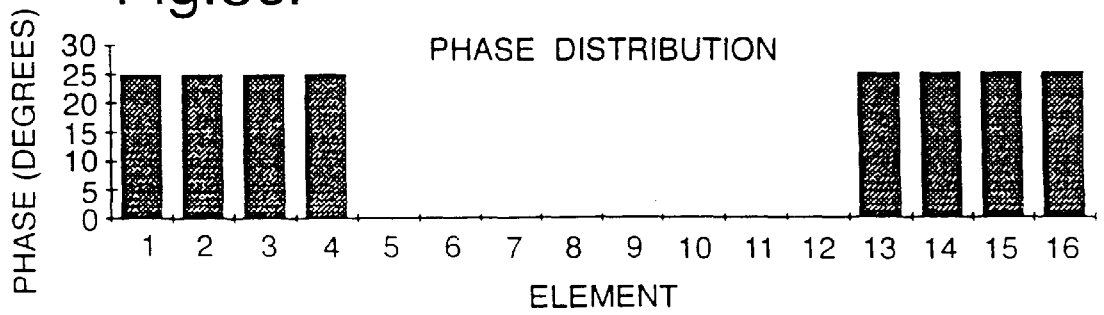
Figure 6A:
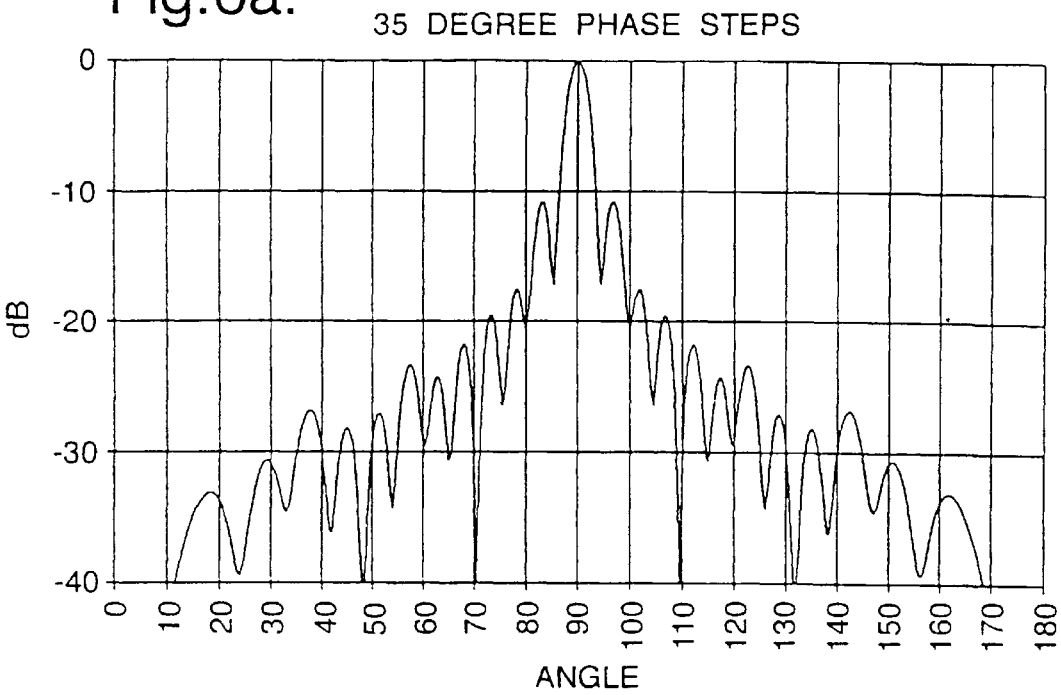
Figure 7A:
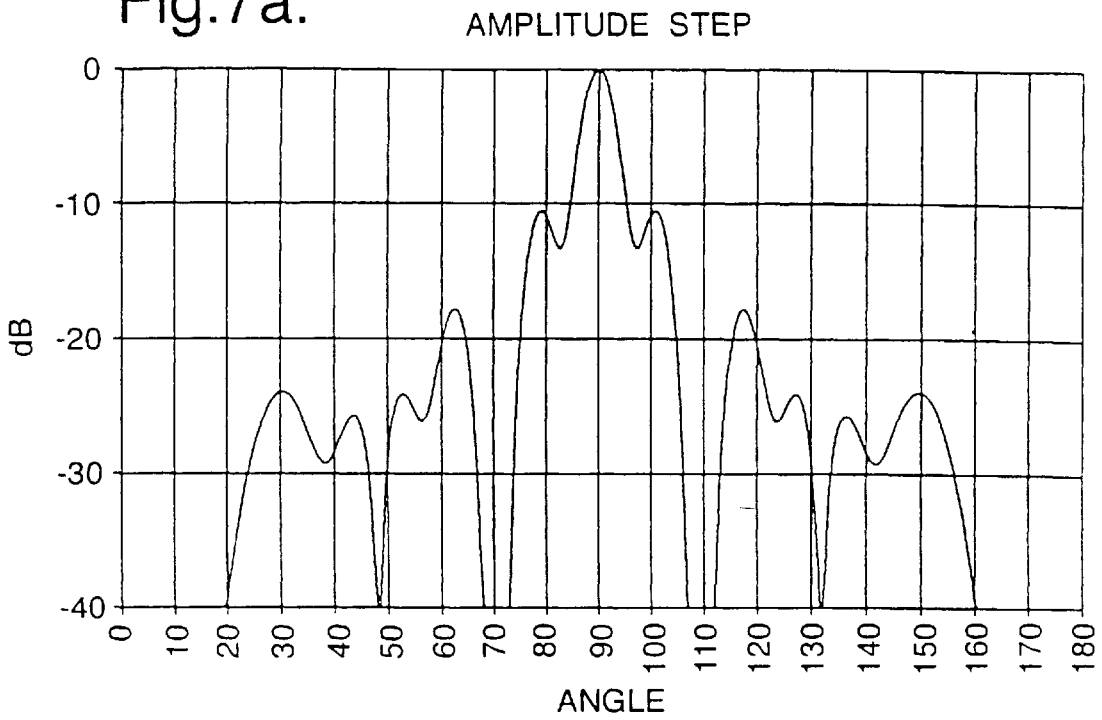
Figure 7B:
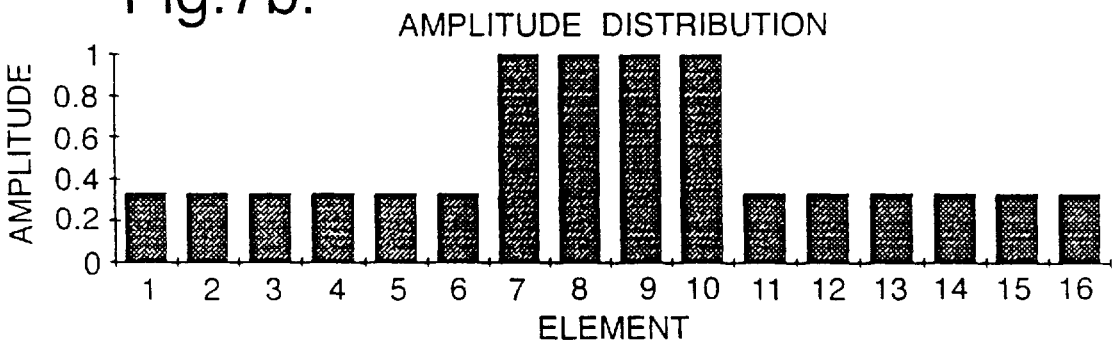
Figure 7C:
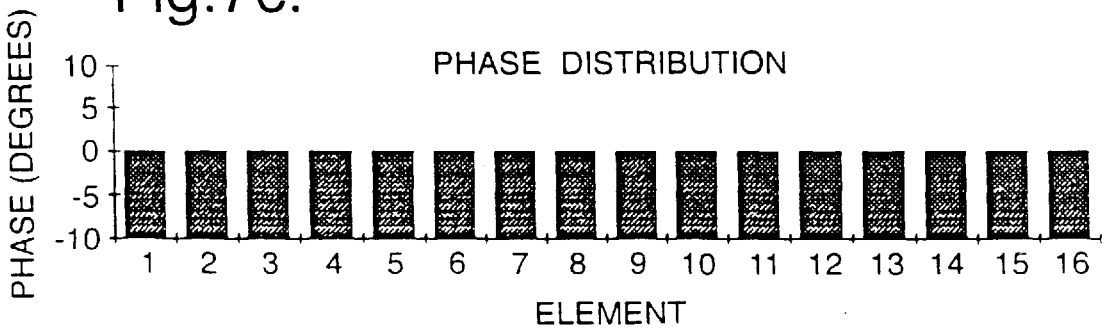

FIGS. 5*a, b* & *c* show the angular radiation intensity distribution, signal amplitude distribution and signal phase distribution of an antenna array having an amplitude and phase distribution of a first embodiment of the invention;

FIGS. 6*a, b* & *c* show the angular radiation intensity distribution, signal amplitude distribution and signal phase distribution of an antenna array having an amplitude and phase distribution of a second embodiment of the invention; and FIG. 7*a, b* & *c* show the angular radiation intensity distribution, signal amplitude distribution and signal phase distribution of a further antenna aray having an amplitude and phase distribution of a third embodiment of the invention.

Figure 1:
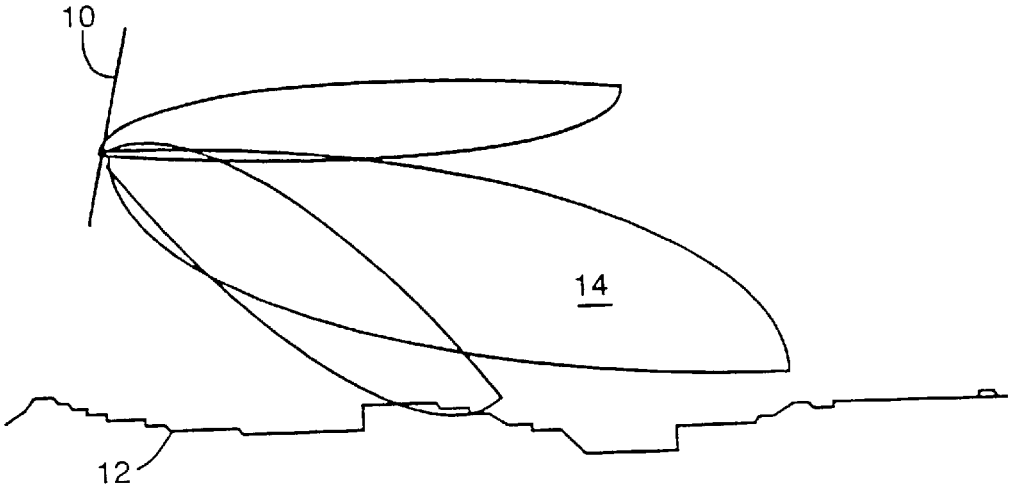
Figure 2A:
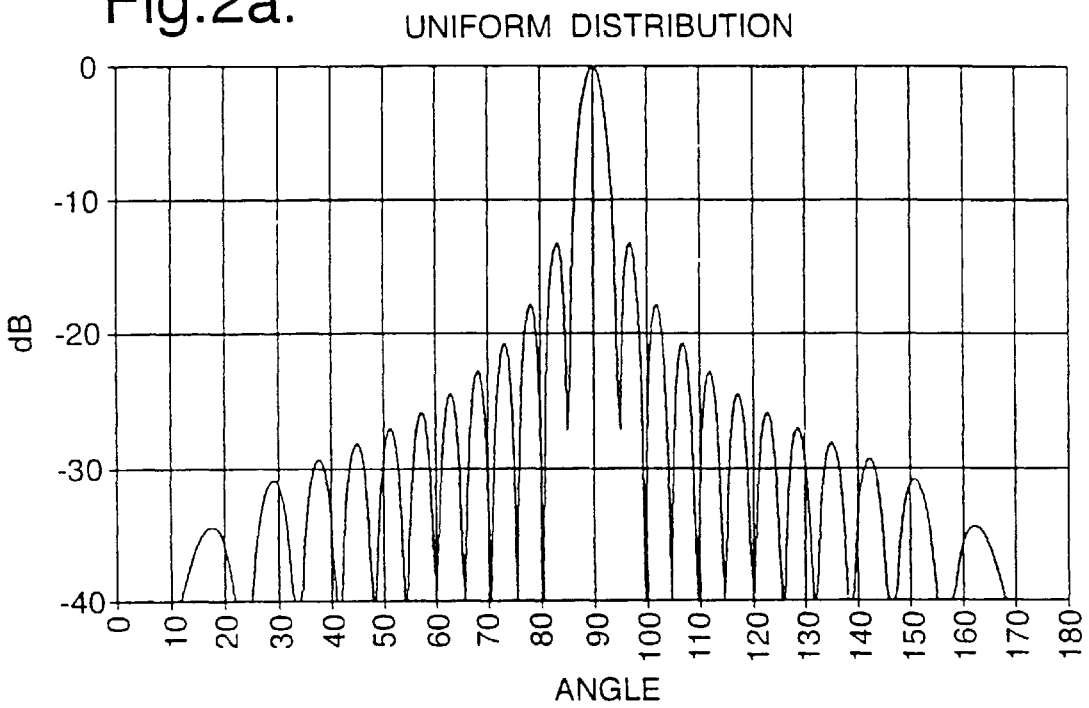
Figure 2B:
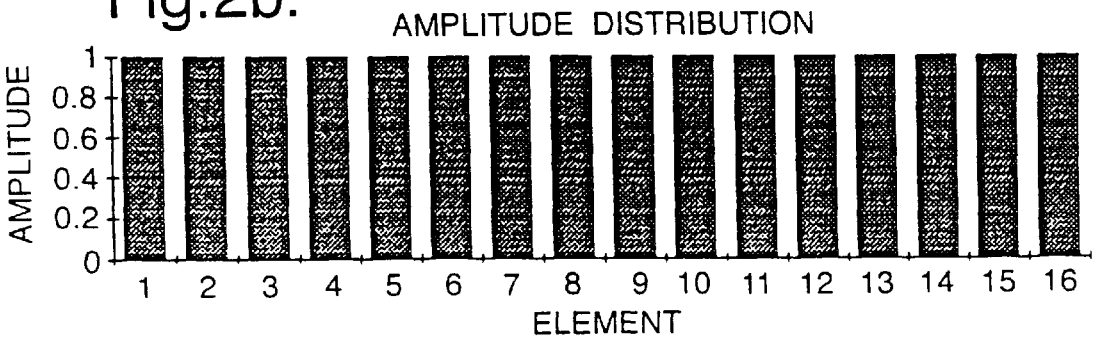
Figure 2C:
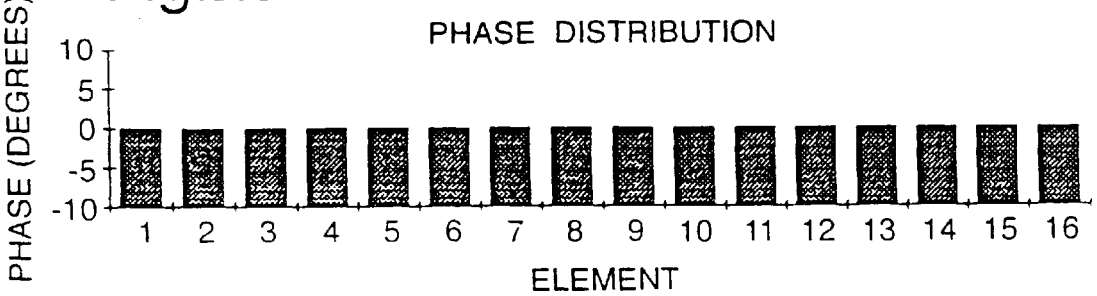

FIG. 1 shows, in section, a linear antenna array 10 operating over a cell 12 which forms a beam having a main lobe 14 normal with respect to the array. Since the array is tilted downwardly, the central lobe serves the far-field, with the sidelobes serving the near-field. The feed network provides equal phase and amplitude paths from an input of the antenna array to each of the antenna elements. The nulls between the lobes can be seen to provide a non-uniform coverage. The beam provided by this arrangement has an intensity distribution as shown in FIG. 2*a*—there is a central lobe with sidelobes of reduced intensity, which sidelobes are separated from adjacent lobes by instances of low power or nulls. Electrical downtilt will have much the same effect, with the nulls being steered together with the radiating lobes.

Figure 4:
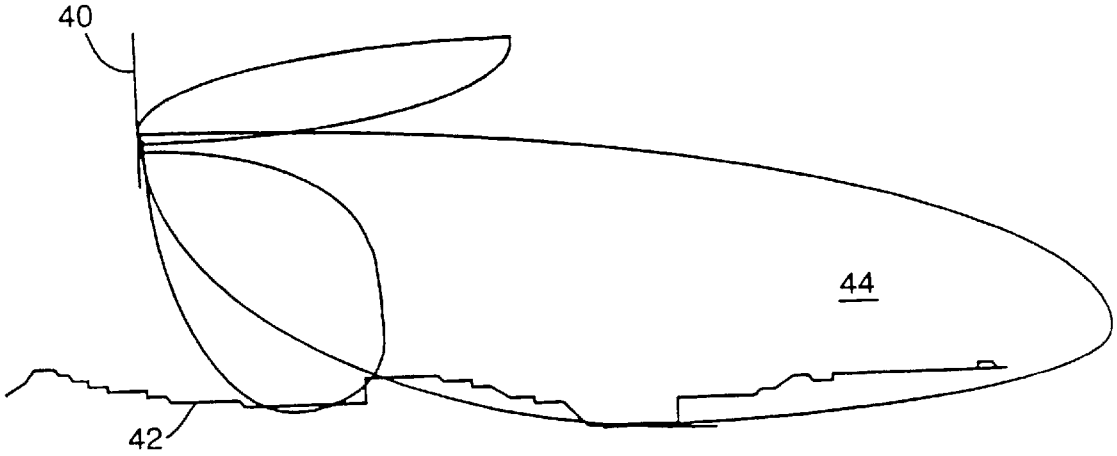
FIG. 4 is a schematic representation of a beam from an antenna array made in accordance with the invention.
Figure 3:
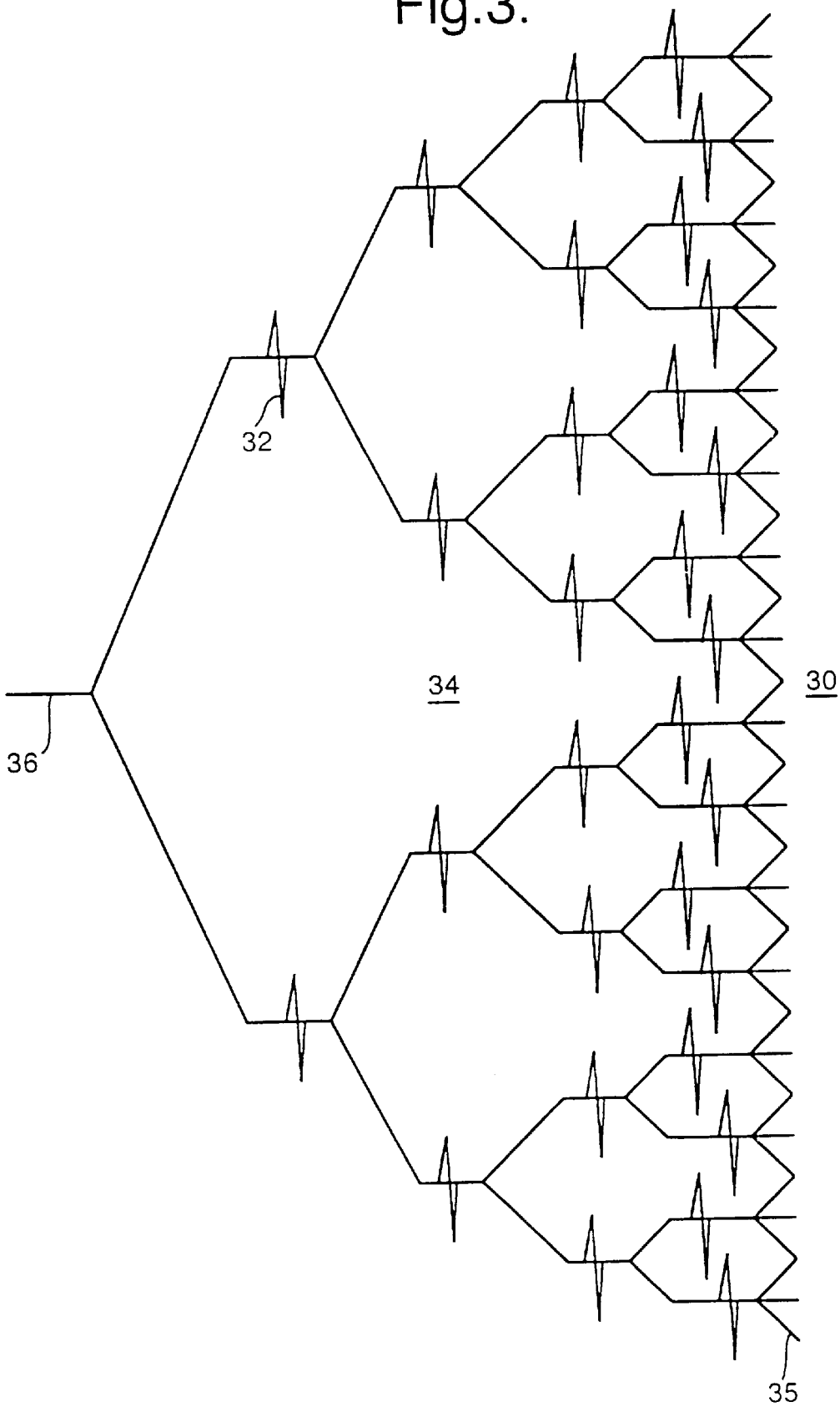
FIG. 3 is a linear antenna array having a feed network in accordance with one embodiment of the invention.

FIG. 3 shows an array wherein the feed network 34 provides varying paths 32 from an input 36 to each of the antenna elements 35 of the antenna array 30. The varying paths introduce differences by way of unequal power division at path splits or by differences in path length. The beam shapes represented in FIGS 5*a* to 7*a* are provided by feed networks having the amplitude and phase distributions as shown in FIGS. 5*b* to 7*b* and FIGS. 5*c* to 7*c* respectively. The phase shifts in the feed paths for the antenna elements have been effected progressively across the antenna array (also known as a phase taper) together with a phase shift or amplitude shift for a group of antenna elements. This progressive series of phase shifts along the antenna array has the primary result of effecting downtilt. Typically, a phase taper for an array will be 10–90° phase difference between antenna elements of an array, which elements are spaced ½–¾ wavelengths apart. A representation of such an antenna in use is shown in FIG. 4, wherein the antenna array 40 provides an electrically downtilted beam 44 operating over a cell sector 42, with null fill-in. The many benefits in the design and installation of such antenna arrays in comparison with mechanical downtilting can easily be envisaged; moreover, the coverage defined is near uniform by reason of the nulls between lobes not being significant.

Figure 6B:
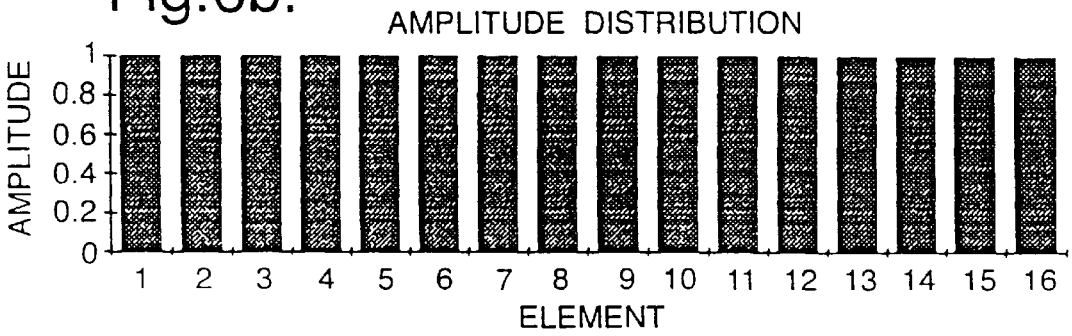
Figure 6C:
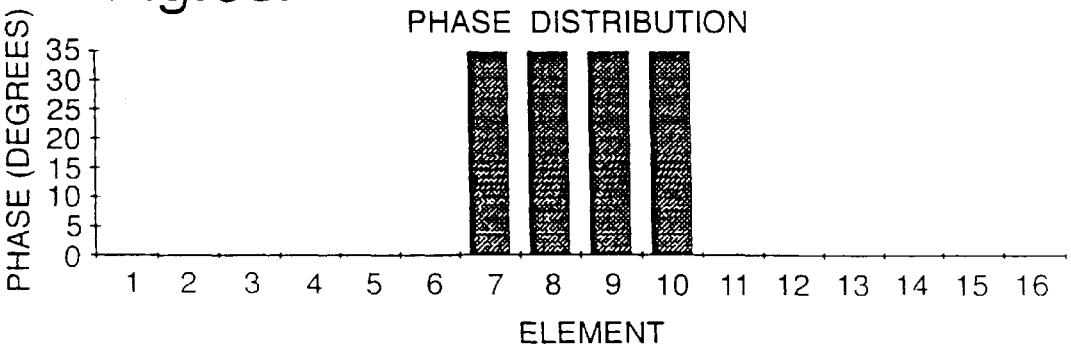

The linear antenna arrays of FIGS. 5 to 7 comprise 16 antenna elements. In a layered or flat plate arrangement the antenna arrays are arranged vertically to provide a beam which is narrow in elevation. The microwave signals from the base station transmitter are introduced or coupled to an antenna array feed network printed upon a dielectric substrate of an antenna by, typically, a coaxial line arrangement. The feed network provides a signal for each antenna element. The radiation pattern provided by each antenna element cooperates with the radiation pattern provided by the other antenna elements within an antenna array whereby the resulting radiation intensity distribution is the sum of all the radiation distributions of all the antenna elements within the antenna array. The antenna array can be deployed mounted on a mast or other type of suitable structure.

In one embodiment of the invention, the feed paths between the first to sixteenth antenna elements comprise, in addition to the progressive phase change, a series of a first group of antenna elements having a phase difference with respect to a second group of antenna elements. The feed network for each antenna element can be arranged such that the phase of a further group of antenna elements is different. FIG. 5 shows a radiation distribution for such a case in which nulls between the first two side lobes and the central lobe are absent. The elements of the antenna array can also be grouped as in FIG. 6, to provide null fill-in between first and second side lobes as well.

Alternatively, the feed paths need not be grouped for antenna elements having similar phase shifts, but the power split between tracks of the feedback path can be such that, in addition to the progressive phase change, an amplitude difference for a group of the antenna elements be effected. The effect of changing the amplitude of a feed input for a group of antenna elements is in many ways similar to the effect of changing the phase of a feed input for a group of elements, since both the amplitude and phase are components of the complex excitations of the radiated signals. The power splits in the feed paths between the first to sixteenth antenna elements may vary for a first group of antenna elements having the same amplitude and a second group of antenna elements with a fixed amplitude change with respect to the other antenna elements. The feed network for each antenna element can be arranged such that the amplitude of a consecutive group of antenna elements is different. FIG. 7 shows a radiation distribution for a case wherein the antenna elements 7–10 of the antenna array have an amplitude of a magnitude three times that of the other antenna elements; the nulls between the first two side lobes and the central lobe are absent.

Whilst the principle of increasing transmission path lengths may appear to be straightforward the same cannot be said for the realisation of such features. Typically antenna arrays are situated up a mast or some other suitable structure; weight and size constraints determine what can be added to an antenna array. Furthermore components for fabrication are expensive. Thus weight, size and manufacturing costs must be minimised.

Flat-plate or layered antenna technology is such that feed networks are arranged on a thin dielectric sheet between two ground planes of the antenna with only the portions forming radiative probes being situated within apertures or radiating elements formed in the ground planes. The feed network for the radiating probes must be situated between the ground planes i.e. to the side of the apertures, in order that unintended coupling effects do not take place. Thus differences in path length, power splits, and the like can only be accommodated if the resulting network does not compromise the performance of the antenna elements. A particular problem arises in the division of the signals from the input transmission line to the antenna. If the signals are input via a coaxial cable then the signals can be coupled via a reactive coupling scheme whereby the coaxial cable feeds a number of Wilkinson dividers (or other type of divider) the outputs of which couple with input arms of the feed network. The use of thin dielectric films does not lend itself to simple and cheap fabrication of input signal connection since such thin dielectric films cannot easily be soldered. The use of reactive coupling schemes (see pending patent application GB9506878.9) requires the use of a small substrate of ceramic (or similar). Such substrates, by reason of fragility and of expense, must be of a small size and any signals coupled from this substrate should be of equal amplitude and phase, with the signal power and phase division occurring on the tracks defined on the dielectric film.

For amplitude variations to be implemented in a circuit, it is preferable to employ unequal dividers at appropriate junctions such that amplitude shifts occur for a group of antenna elements. Phase shifting is preferably implemented after signal division to reduce the effects of varying effects with amplitude and signal strength. In order that signals carried by a ceramic substrate are equal in phase and amplitude, isolated dividers should be used on the substrate, such as Wilkinson dividers. It is to be noted that the use of such dividers is generally contrary to the requirements for a low cost and easy to fabricate arrangement. The advantages of an isolated coupler are that no reflections are produced and no phase differences arise. If a non-isolated divider were to be used, then changes in the complex excitation division will depend upon the amplitude and phase of any reflected signals (which vary with frequency), which will introduce phase errors and may, in turn, negate any benefit that may otherwise have been achieved. Accordingly, the shifts in complex excitation to achieve null fill-in are preferably associated with isolated dividers in the feed network. The use of a minimum number of shifts is therefore advantageous.

Whilst only embodiments providing both amplitude or phase shifts to a group of antenna elements has been shown, the same advantages can be provided by a combination of such shifts. In many configurations, it is preferable only to effect phase shifting, since unequal power division requires more circuit space due to the larger space requirements of unequal power dividers. In certain cases, there is no requirement for downtilt but only null fill-in; in these cases, the progressive phase shift across the antenna elements can be zero.

We claim:

1. A linear array comprising a number (N) of antenna elements and a feed network, wherein the feed network is operable to apply non-progressive levels in phase distribution to one or more selected groups of two or more antenna elements to provide a null free coverage over a specific part of a resultant radiation pattern, wherein the number (n) of antenna elements in any group is less than N.

2. An antenna array according to claim 1 wherein the feed network is operable to apply a progressive phase shift across the antenna elements, which phase shift is cumulative to the levels in the phase distribution, whereby the resultant radiation pattern is downtilted.

3. An antenna array according to claim 1 or 2 wherein the phase shifts in the feed network are provided by differing length transmission paths.

4. An antenna array according to claim 1, wherein amplitude shifts are effected to further selected groups of antennas.

5. An antenna array according to claim 4, wherein the amplitude shifts are provided by unequal power dividers.

6. A method of operating a linear antenna array comprising a number (N) of radiation elements and a feed network; the method comprising the application of non-progressive levels in phase distribution to one or more groups of antenna elements whereby a null free coverage is provided in a resultant radiation pattern over a specific part of a resultant radiation pattern, wherein the number (n) of antenna elements in any group is less than N.

7. A method according to claim 6 further comprising the application of progressive phase shifts in the signals fed to consecutive antenna elements in the array whereby the resultant radiation pattern is downtilted.

8. An antenna array according to claim 6 wherein the phase shifts in the feed network are provided by differing length transmission paths.

9. A method according to claim 6 wherein amplitude shifts are effected to further selected groups of antennas.

10. A method according to claim 9 wherein the amplitude shifts are provided in the feed network by unequal power dividers.

11.A linear antenna array comprising a number (N) of antenna elements and a feed network, wherein the feed network is operable to apply non-progressive levels in phase distribution to one or more selected groups of two or more antenna elements to provide a null free coverage over a specific part of a resultant radiation pattern, and wherein amplitude shifts are provided by unequal power dividers and are effected to further selected groups of antennas, wherein the number (n) of antenna elements in any group is less than N.

12. An antenna array according to claim 11 wherein the feed network is operable to apply a progressive phase shift across the antenna elements, which phase shift is cumulative to the non-progressive levels in the phase distribution, whereby the resultant radiation pattern is down tilted.

13. An antenna array according to claim 11 wherein non-progressive phase shifts in the feed network are provided by differing lengths transmission paths.

14. An antenna array according to claim 11 wherein the feed network is operable to apply a progressive phase shift across the antenna elements, which phase shift is cumulative to the non-progressive levels in the phase distribution, whereby the resultant radiation pattern is down tilted, and non-progressive phase shifts in the feed network are provided by differing lengths transmission paths.

15. A telecommunications system incorporating an antenna array as claimed in any of claims 1 to 6 or 11 to 14.

16. A method of operating a linear antenna array comprising a number (N) of radiation elements and a feed network, the method comprising the application of non-progressive levels in phase distribution to one or more groups of antenna elements whereby a null free coverage is provided in a resultant radiation pattern over a specific part of a resultant radiation pattern, and wherein amplitude shifts provided in the feed network by unequal power dividers and are effected to further selected groups of antennas, wherein the number (n) of antenna elements in any group is less than N.

17. A method according to claim 16 further comprising the application of progressive phase shifts in the signals fed to consecutive antenna elements in the array whereby the resultant radiation pattern is downtilted.

18. An antenna array according to claim 16 wherein non-progressive phase shifts in the feed network are provided by differing lengths transmission paths.

* * * * *